United States Patent [19]

Segatz

[11] Patent Number: 4,685,595

[45] Date of Patent: Aug. 11, 1987

[54] HAND-OPERATED IMPLEMENT FOR DISCHARGING PASTY SUBSTANCES

[75] Inventor: Wilhelm Segatz, Zell, Fed. Rep. of Germany

[73] Assignee: ARA-Werk Kraemer GmbH & Co., Fed. Rep. of Germany

[21] Appl. No.: 709,338

[22] Filed: Mar. 7, 1985

[30] Foreign Application Priority Data

Mar. 16, 1984 [DE] Fed. Rep. of Germany ..... 3409724

[51] Int. Cl.[4] ..... B67D 5/42

[52] U.S. Cl. ..... 222/326; 222/386; 222/387; 222/391

[58] Field of Search ..... 222/387, 389, 391, 340, 222/386, 325-327; 92/52; 267/64.11

[56] References Cited

U.S. PATENT DOCUMENTS

| | | | |
|---|---|---|---|
| 2,361,126 | 10/1944 | Klein | 222/386 X |
| 2,567,960 | 9/1951 | Myers et al. | 222/387 X |
| 2,915,226 | 12/1959 | Sundholm | 222/387 X |
| 3,433,393 | 3/1969 | Ballu | 222/402 |
| 3,595,448 | 7/1971 | Carlton | 222/327 |
| 3,870,287 | 3/1975 | McMahon | 267/64.11 X |
| 3,901,414 | 8/1975 | Capra et al. | 222/340 |
| 4,113,144 | 9/1978 | Hein et al. | 222/396 |
| 4,240,619 | 12/1980 | Wirges et al. | 267/64.11 |
| 4,376,498 | 3/1983 | Davis, Jr. | 222/389 X |
| 4,408,751 | 10/1983 | Dodson et al. | 267/64.11 X |

FOREIGN PATENT DOCUMENTS

| | | |
|---|---|---|
| 2733310 | 8/1979 | Fed. Rep. of Germany . |
| 2049299 | 3/1971 | France . |
| 1273332 | 5/1972 | United Kingdom . |

*Primary Examiner*—Robert J. Spar
*Assistant Examiner*—Jay J. Alexander
*Attorney, Agent, or Firm*—Steele, Gould & Fried

[57] ABSTRACT

This implement, which is particularly suitable for discharging pasty sealing compounds, has a cylinder for receiving a cartridge containing the substance, a plunger axially displaceable in this reception cylinder, a device for axially displacing the plunger, as well as a manually operable device for controlling the particular discharge quantity, while being equipped with a gas spring by means of which the plunger is axially displaceable.

25 Claims, 3 Drawing Figures

HAND-OPERATED IMPLEMENT FOR DISCHARGING PASTY SUBSTANCES

BACKGROUND OF THE INVENTION

The present invention relates to a hand-operated implement for discharging pasty substances, such as sealing compounds, with a cylinder for receiving the substance, particularly for receiving a cartridge containing the substances, a plunger axially displaceable in the reception cylinder, a device for axially displacing the plunger and a manually operable device for discharging a desired quantity.

The hitherto known implements of this type include those in which a mechanical device, generally equipped with a rack is provided for the axial displacement of the plunger. In the case of such implements, the plunger can only be axially displaced in stepwise manner, so that such implements have only proved satisfactory in those cases where uniform material discharge is not required, such as in the case of pressed lubricating grease. However, if such implements are used for discharging pasty sealing compounds or the like for the purpose of filling visible gaps, such as those which unavoidably occur when fitting baths, their non-uniform material discharge leads to labourintensive aftertreatment of the joined areas.

Therefore, implements of the aforementioned type have already been developed, in which the axial displacement of the plunger takes place by compressed air supplied via a flexible hose. These hand-operated implements operating with compressed air require a relatively high apparatus expenditure and can also not be used in all cases, namely if there is no compressor or no power supply for operating the compressor. In addition, the pressure hose leading thereto is often also disadvantageous in connection therewith.

In addition, implements of the aforementioned type have been developed, in which the axial displaceability of the plunger is brought about by a compressed gas supplied thereto from a small compressed gas cartridge housed in the implement. However, in the case of such implements, sealing problems occur, which are particularly serious in view of the limited cartridge volume. It is also disadvantageous therewith that it is not readily possible to determine the degree of filling of the compressed gas cartridge, so that spare cartridges have to be kept. In addition, such implements do not permit precise working, because their discharging means have a rotary slide valve, which cannot be operated in a sensitive manner.

BRIEF SUMMARY OF THE INVENTION

An object of the present invention is to provide an optimum maintenance-free implement of the aforementioned type which, without great apparatus expenditure and without the use of additional parts, compressed gas cartridges of the like, permits a uniform material or substance discharge so as to make a labour-intensive after treatment of joined areas superfluous.

According to the invention, this problem is solved by an implement having a gas spring by means of which the plunger is axially displaceable. This gas spring can be reset by the user and has the advantage that it operates with a constant pressure over the entire lift range, which ensures a uniform material discharge. It also operates in a completely maintenance-free manner and furthermore obviates the need for providing additional or spare parts. The use of a gas spring also obviates sealing problems of the type occurring with implements equipped with compressed gas cartridges.

The gas spring is arrestable in any random position, so that the said gas spring can be used for discharging a desired quantity and there is no need for a separate discharge-controlling mechanism.

When a particularly uniform substance discharge control are required, it is possible to provide a separate discharge-controlling mechanism, which can comprise a manually operable valve arranged on the end face of the reception cylinder. It is particularly advantageous to use a preferably short-stroke slide valve, which withstands the pressure which occur without giving rise to sealing problems and is preferably arranged in such a way that the valve slide axis is at right angles to the longitudinal axis of the reception cylinder. It is possible to associate with the valve a locking spring, which ensures an automatic closing of the valve. If the valve is constructed as a slide valve, the spring is preferably constructed as a compression spring acting on the valve slide.

The valve forming the discharge-controlling mechanism can be arranged in a spraying nozzle connected to the reception cylinder. According to a preferred embodiment, this spraying nozzle is detachably connected to the reception cylinder, e.g. is screwed thereto and is constructed as its cover, so that it forms a compact unit with the valve which can be easily replaced. This is always advantageous in the case of valve contamination, or if the implement has to work with a different type of pasty substance.

The gas spring can be connected to the implement in such a way that its cylinder is displaceable and preferably connected to the plunger, whereas its piston rod is arranged in stationary manner, which leads to the advantage that access to the gas spring seal, i.e., the most sensitive area of the gas spring, is located on the cylinder side remote from the plunger and for this reason alone is protected from external influences. It is also possible with this arrangement of the gas spring to make the free gas spring cylinder end guide-free and this is also the case in a preferred embodiment which will be described in greater detail hereinafter. In this embodiment, a substantially cylindrical protective casing aligned with the reception cylinder is provided and at least surrounds the particular piston rod section projecting from the gas spring cylinder and protects it against contamination, which could lead to the gas spring seal or washer becoming damaged. The free end of the piston rod can be mounted in the rear end region of this protective casing. It is preferably articulated there with a clearance, which gives the advantage that the piston rod can be automatically aligned.

A manually operable resetting mechanism, preferably having a bar structure operable to clamp against and retract the gas spring, can be provided for resetting the gas spring and in a preferred embodiment, it engages on the gas spring cylinder casing. In this embodiment, the gas spring cylinder is longer than the reception cylinder, so that a part of the gas spring cylinder still projects rearwards out of the reception cylinder when the gas spring is fully extended.

If the gas spring cylinder is longer than the reception cylinder, the resetting mechanism engaging on the gas spring cylinder casing can be located between the reception cylinder and the protective casing, which leads to the advantage that neither the reception cylinder, nor the protective casing, has to have openings for the resetting mechanism. It is also possible to provide a base part, to which is connected both the reception cylinder and the protective casing and preferably the resetting mechanism is articulated thereto. This base part can have two sliding sleeves used for guiding the gas spring cylinder, one being fixed in the preferably detachable bottom of the reception cylinder and the other on the end face of the protective casing.

The valve slide of the slide valve forming the discharge-controlling mechanism can have an end face which is accessible from the outside, by means of which the valve can be pressed into its open position counter to the tension of its locking spring. A lever cooperating with this end face of the valve slide can be articulated to the spraying head to permit the valve to be operated without difficulty. The lever can be constructed as an operating lever. According to a preferred embodiment, to permit easier manipulation, said lever is operable by an operating mechanism arranged in the vicinity of the resetting mechanism.

The resetting mechanism provided for the gas spring can have a manually releasable locking device which keeps the gas spring in the tensioned state and, if desired, with it can be associated an unlocking member.

The implement according to the invention can have a pistol grip-like handle, which is preferably located in the vicinity of the resetting mechanism, while the operating mechanism can be constructed as an outlet tap cooperating with the handle.

BRIEF DESCRIPTION OF THE DRAWINGS

There are shown in the drawings embodiments which are presently preferred it being understood, however, that this invention is not limited to the precise instrumentalities and arrangements shown.

DETAILED DESCRIPTION OF THE PREFERRED EMBODIMENTS

Figure 1:
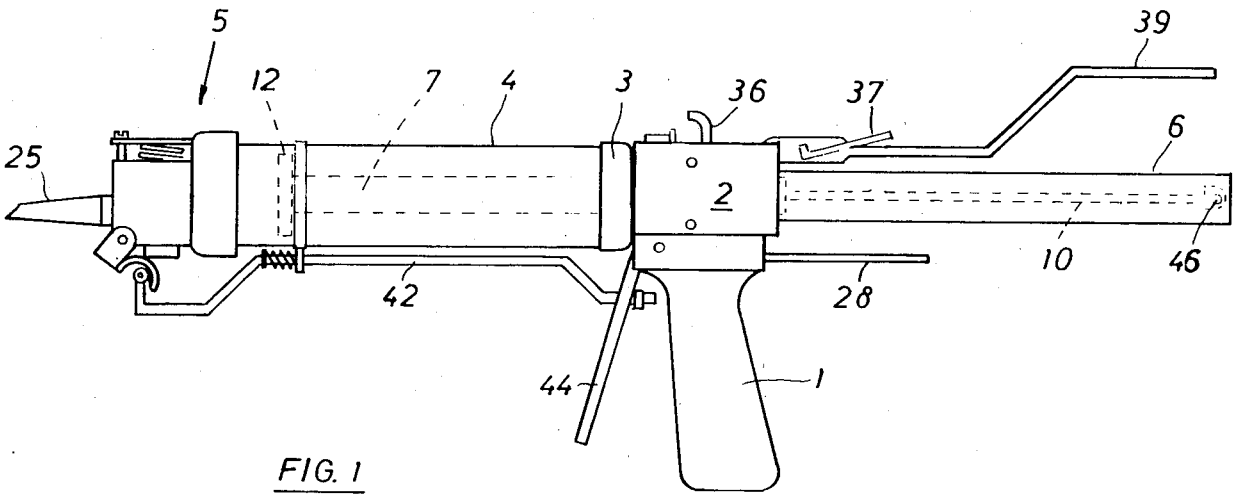
FIG. 1 a side view of a hand-operated implement for discharging pasty substances according to the invention.

The implement shown in FIG. 1 has a pistol grip-like handle 1, to which is fixed a base part 2. The bottom 3 of a cylinder 4 is fixed to the side of base part 2 pointing to the left in FIG. 1 for receiving a pasty substance, e.g. a pasty sealing compound. The bottom 3 has a cap-like construction and is detachably connected by screwing to the reception cylinder 4. A discharge head 5, which has a valve, is fixed by screwing to the free end of reception cylinder 4 remote from base part 2.

A cylindrical protective casing 6 aligned with reception cylinder 4 is fixed to the side of base part 2 remote from said cylinder 4.

Figure 3:
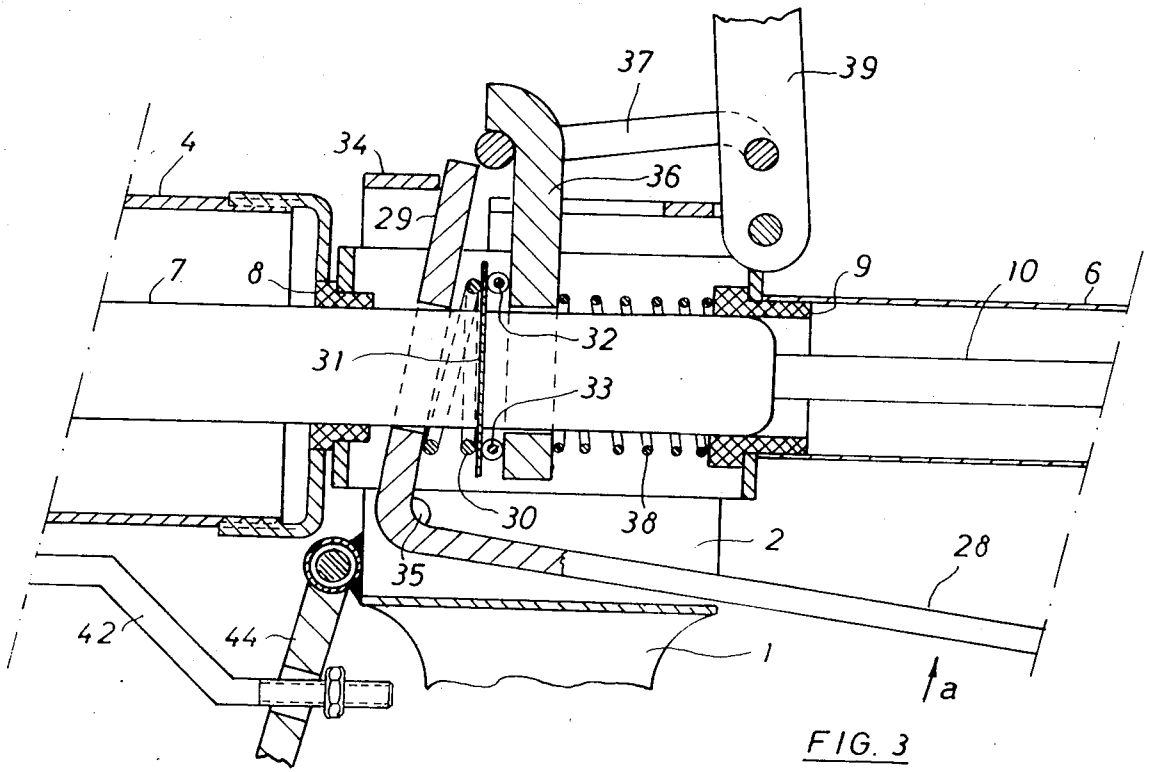
FIG. 3 a part sectional side view of the handle area of the implement shown in FIG. 1 on a larger scale.

The cylinder 7 of a gas spring 11 is mounted in two sliding sleeves 8, 9 in base part 2 (cf FIG. 3) and the piston rod 10 thereof extends into the rear end of protective casing 6, where it is articulated by means of a pin 46.

A plunger 12, which is circular in plan view, is fixed to the end of the gas spring cylinder 7 pointing to the left in the drawing, i.e., to the bottom of the gas spring cylinder. The external diameter of the plunger is smaller than the internal diameter of reception cylinder 4 and the cartridge (not shown) arranged therein, so that it can axially displace the piston-like bottom of said cartridge.

Figure 2:
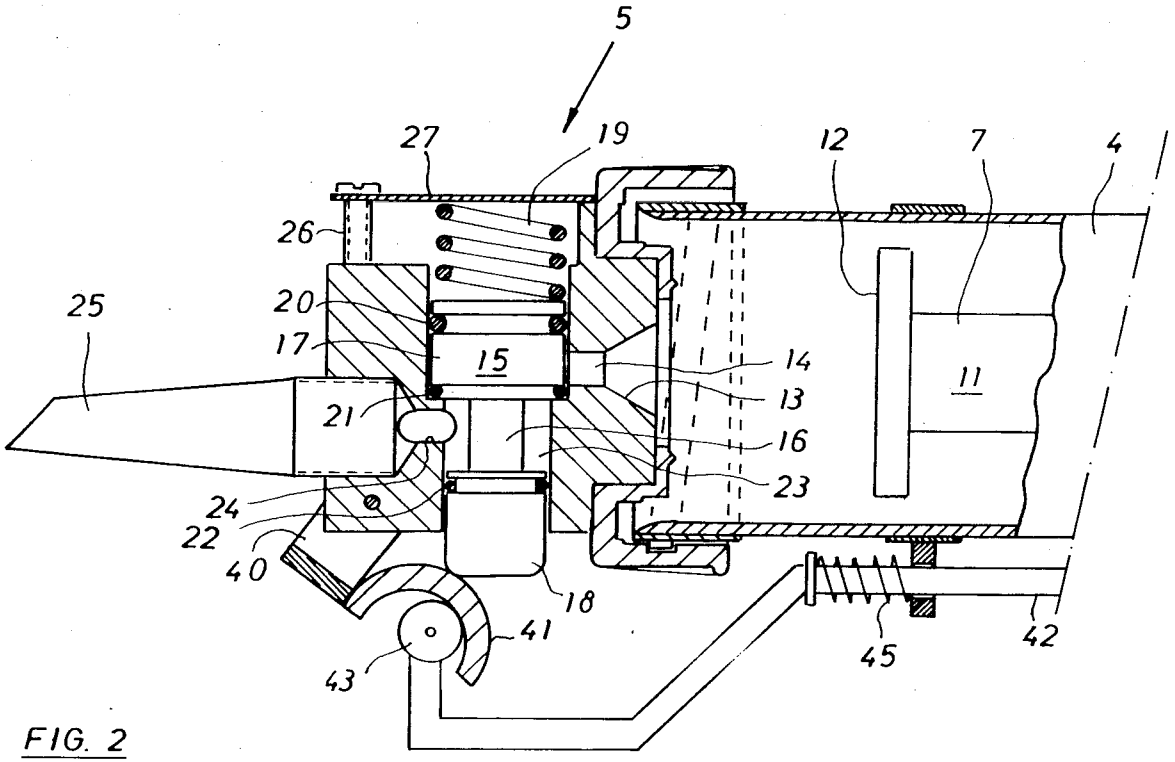
FIG. 2 a part sectional side view of the spraying head-side area of the implement shown in FIG. 1 on a larger scale.

Discharging head 5, shown on a larger scale in FIG. 2 and which, as stated, is screwed to the reception cylinder 4, has a substantially funnel-shaped receptacle 13 for the front cartridge end. To said receptacle 13 is connected a passage 14, whose cross-section corresponds to that of a narrow rectangle with semicircular narrow sides, the longitudinal sides of said rectangle being at right angles to the drawing plane. Passage 14 leads to a slide valve, whose slide 15 is constructed in rotationally symmetrical manner and has two pistons 17, 18 interconnected by means of a central post 16. The diameter of the upwardly directed piston 17 in the drawing is larger than that of the downwardly directed piston 18. Spraying head 5 has a through two-stage bore for guiding the two pistons 17, 18 and which also guides a compression spring 19, with which the larger diameter piston 17 (at the top in the drawing) is forced downwards into its closed position (shown in FIG. 2), which closes the outlet of passage 14. Piston 17 has two all-round grooves, in each of which is arranged an O-ring packing 20, 21 used for sealing piston 17. The smaller diameter piston 18 (at the bottom in the drawing) also has an all-round groove, in which is arranged an O-ring packing 22 sealing said piston.

If the small piston 18 is pressed in counter to the tension of spring 19, then the large piston 17 frees the hitherto closed outlet of passage 14, so that a pasty substance in said passage can pass into the interior of the valve formed by the two-stage bore in the spraying head 5, i.e. into the cylindrical area 23 bounded at the top by piston 17 and at the bottom by piston 18 and from these passes to a discharge nozzle 25 via a passage 24. Discharge nozzle 25 is screwed into the spraying head 5, so that it can be replaced at any time.

The end of compression spring 19 remote from piston 17 is supported against a plate 27 held by screws 26. By loosening screws 26 and disassembling plate 27, the valve can be easily removed. The compressive force of spring 19 can be varied equally easily. It is merely necessary to tighten screws 26 to a greater or lesser extent.

In base part 2 carried by handle 1, cylinder 7 of gas spring 11 is guided in two sliding sleeves 8, 9 in which said cylinder can be axially displaced. For axial displacement to the right, i.e., into protective casing 6, base part 2 has a resetting mechanism having manually-operable bars for clamping upon and retracting the gas cylinder, and with which is associated a locking device. The latter has a substantially L-shaped lever, whose long leg 28 is constructed as a handle projecting downwards out of the housing of base part 2, while its short leg 29, largely arranged within the housing of base part 2, has an approximately circular opening in which gas spring cylinder 7 is guided with clearance, the diameter of said opening being larger in the direction of the short leg than in the transverse direction. A spring 30 presses against the short leg 29 of said L-shaped lever. Spring 30 is supported at the back against a thin support plate 31 having a central opening. Two retaining pins 32, 33, at right angles to the drawing plane, are provided in base part 2 for securing said plate 31. The free end of short leg 29 of the L-shaped lever projects upwards and out of base part 2 and engages there on a web 34 of base part 2 serving as a swivel bearing for the complete L-shaped lever, so that the short leg 29 is tilted by spring 30 acting thereon and assumes the position shown in FIG. 3, where it is wedged with the gas spring cylinder 7 in such a way that the latter can only be moved rearwards, towards the end of piston rod 10, but not forwards towards the discharging head 5. However, it can be moved out of this wedged position by pressing the long leg 28 in the direction of arrow a, so that the complete L-shaped lever is swivelled in the direction of arrow a about its swivel bearing formed by web 34 until the wedging effect of gas spring cylinder 7 with the edges of the opening in short leg 29 is ended, enabling said cylinder 7 to now also be axially displaced forwards, i.e. towards discharge head 5. To keep the L-shaped lever in this position, a receiving bore 35 for a not shown retaining pin is provided in the lower area of the housing of base part 2.

The resetting mechanism has a shim 36, which surrounds the gas spring cylinder 7 with clearance, a tensioning member 37 which can be brought into operative connection therewith, a compression spring 38 surrounding cylinder 7 and a tensioning lever 39 articulated to base part 2 and which can be pivoted into the drawing plane member 37 being articulated to lever 39. Shim 36 is a substantially rectangular, relatively thick plate having in its lower area in the drawing an approximately circular opening, whose diameter is slightly larger in the longitudinal extension of the shim than in the transverse direction. Shim 36 is dimensioned in such a way that its narrow side projects out of base part 2. The upper edge of this narrow side is forwardly bent over, i.e. towards discharge head 5. Tensioning member 37 is constructed in chain link-like manner and is articulated to tensioning lever 39. The end of tensioning member 37 remote from tensioning lever 39 can be placed over shim 36 when lever 39 is pivoted forwards, i.e. in the direction of spraying head 5, so that it engages behind its forwardly bent over edge. If tensioning lever 39 is now pivoted rearwards, this initially leads to the pivoting of shim 36 and its wedging with the gas spring cylinder 7. A further pivoting of tensioning lever 39 leads to shim 36, as well as gas spring cylinder 7 wedged therewith, being moved a short distance of approximately 10 to 15 mm rearwards, ie. in the direction of protective casing 7 counter to the tension of compression spring 38, which leads to a resetting, i.e. a pressing in of the gas spring. If this axial displacement of the gas spring cylinder 7 takes place when the L-shaped lever of the locking mechanism has assumed the locking position shown in FIG. 3, this leads to the gas spring not being automatically relaxed, i.e. its cylinder 7 cannot be moved forwards in the direction of spraying head 5. Through multiple operation of tensioning lever 39, gas spring 11 can be set back, i.e. pressed in to such an extent that plunger 12 fixed to the bottom of its cylinder 7 engages with the bottom of reception cylinder 4, so that the latter can be loaded with a cartridge filled with a pasty substance. When this has been completed, spraying head 5 can be screwed to the reception cylinder 4. When screwing of spraying head 5 and reception cylinder 4 has been completed, the locking mechanism can be released by pressing in the longer, grip-like leg 28, so that the gas spring relaxes and its cylinder 7 moves forwards, i.e. in the direction of discharge head 5 and presses the plunger fixed thereto against the piston-like cartridge bottom. The pasty substance in the cartridge is now pressed forwards, i.e. in the direction of discharge head 5 and can be discharged by operating the valve provided there. In order to open this valve, its slide 15 must be pressed in counter to the tension of the spring 19 associated therewith, which is fundamentally also directly possible through finger pressure. However, in the represented embodiment, a lever bar is provided for this purpose and comprises several cooperating parts, namely a lever 40 articulated to discharge head 5, which has a hemispherical shell-shaped shoulder 41 and is operable by means of a multiply bent tie rod 42 running parallel to reception cylinder 4 and guided thereon, which has a roller 43 cooperating with the hemispherical shell-shaped shoulder 41 of lever 40 and whose other end leads to an outlet tap 44 articulated to base part 2. A compression spring 45 is associated with tie rod 42 and ensures that when outlet tap 44 is not operated, the tie rod is moved forwards in the direction of spraying head 5. If the outlet tap 44 is operated, the tie rod 42 is drawn rearwards, so that shoulder 41 of lever 40 is pressed by roller 43 cooperating therewith against the end face of piston 18, so that valve slide 15 is pressed in and the pasty substance in the cartridge passes through passage 14, the interior of the valve and passage 24 into discharge nozzle 22 and can be discharged.

As a function of the viscosity of the substance to be processed, it is possible to choose a gas spring with a corresponding spring tension. Gas springs with various spring tensions are available, e.g. 10 to 200 kg. The most favourable range for sealing compounds is 50 to 80 kg.

What is claimed is:

1. An implement for discharging a pasty substance, comprising:

a reception cylinder for receiving the substance, the reception cylinder having an end face with a discharge opening through which the substance is forced;

a plunger axially movable in the reception cylinder toward the end face to force the substance through the discharge opening, and movable in an opposite direction to retract;

a gas spring connected to the plunger and operable to urge the plunger toward the end face, the gas spring being resetable by compression in said opposite direction; and, a manually operable valve on the end face of the reception cylinder, operable to open and close the discharge opening.

2. An implement according to claim 1, further comprising a manually-operable resetting mechanism operable to compress the gas spring, the resetting mechanism arresting the gas spring at any random position.

3. An implement according to claim 1, wherein the valve is a short-stroke slide valve, the valve having a slide axis substantially at right angles to a longitudinal axis of the reception cylinder.

4. An implement according to claim 3, further comprising a compression spring associated with the valve, the spring operative to lock the valve by urging the valve to a closed position.

5. An implement according to claim 4, wherein the valve is arranged in a discharge head detachably connected to the reception cylinder and constructed as a cover for the reception cylinder.

6. An implement according to claim 1, wherein the gas spring has a piston rod and a spring cylinder and is connected to the implement such that the gas spring cylinder is displaceble in the implement and is connected to the plunger, while the piston rod of the gas spring is stationary with respect to the implement.

7. An implement according to claim 1, further comprising a substantially cylindrical protective casing aligned with the reception cylinder and at least surrounding a part of a gas spring piston rod section projecting out of the gas spring cylinder.

8. An implement according to claim 8, wherein a free end of the gas spring piston rod is mounted in a rear end area of the protective casing and is articulated there.

9. An implement according to claim 2, wherein the manually operable resetting mechanism is operable by a clamping bar principle, the resetting mechanism having bars clampable to the gas spring and operable to alternately arrest and compress the gas spring.

10. An implement according to claim 9, wherein the resetting mechanism engages on a cylinder casing of the gas spring.

11. An implement according to claim 9, wherein a cylinder of the gas spring is longer than the reception cylinder and the resetting mechanism is located between the reception cylinder and a protective casing of the cylinder of the gas spring.

12. An implement according to claim 7, further comprising a base part to which are fixed both the reception cylinder and the protective casing, and to which a resetting mechanism is articulated.

13. An implement according to claim 9, further comprising a bas part to which are fixed both the reception cylinder and a protective casing of the gas spring and to which the resetting mechanism is articulated.

14. An implement according to claim 3, wherein the base part has two sleeves slidably supporting and guiding the gas spring cylinder, one of the sleeves being fixed in a detachable bottom of the reception cylinder and the other of the sleeves being fixed to an end face of the protective casing.

15. An implement according to claim 14, further comprising a valve slide having an end face which is accessible from outside the implement and by means of which a valve can be moved into an open position counter to tension of a spring urging the valve to close.

16. An implement according to claim 15, further comprising a lever cooperating with an end face of the valve slide, articulated to a discharge head attached to the reception cylinder.

17. An implement according to claim 9, further comprising a lever cooperating with an end face of a valve slide, articulated to a discharge head attached to the reception cylinder.

18. An implement according to claim 16, wherein the lever is operable by means of an operating mechanism arranged adjacent the resetting mechanism.

19. An implement according to claim 17, wherein the lever is operable by means of an operating mechanism arranged adjacent the resetting mechanism.

20. An implement according to claim 18, further comprising a manually detachable locking device on the resetting mechanism, the locking device maintaining the gas spring in a tensioned state.

21. An implement according to claim 2, further comprising a pistol grip-like handle located adjacent the resetting mechanism.

22. The implement of claim 1, further comprising a bar operable to clamp the gas spring, thereby arresting movement of the plunger toward the end face.

23. The implement of claim 22, comprising a resetting mechanism with a shim surrounding a cylinder of the gas spring and a tensioning lever wedged with the gas cylinder, the shim and tensioning lever being operable alternately to arrest the gas spring and to compress the gas spring, and thereby retract the plunger.

24. The implement according to claim 9, wherein the bars of the resetting mechanism include two bars with openings receiving the gas spring, the openings slightly larger than the gas spring such that tilting the bars relative to the gas spring clamps the bars and the gas spring together, and further comprising means for tilting the bars individually and for displacing one of the bars when clamped to the gas spring to thereby retract the gas spring, the two bars being alternately operable to retract the gas spring and to hold the gas spring when so retracted.

25. The implement according to claim 1, wherein the reception cylinder receives removable cartridges containing the substance.

* * * * *